US009074765B2

(12) United States Patent
Armanni

(10) Patent No.: US 9,074,765 B2
(45) Date of Patent: Jul. 7, 2015

(54) GAS BURNER

(75) Inventor: Piero Armanni, Forli (IT)

(73) Assignee: ELECTROLUX HOME PRODUCTS CORPORATION N. V., Brussels (BE)

( * ) Notice: Subject to any disclaimer, the term of this patent is extended or adjusted under 35 U.S.C. 154(b) by 812 days.

(21) Appl. No.: 13/201,265

(22) PCT Filed: Mar. 12, 2010

(86) PCT No.: PCT/EP2010/001571

§ 371 (c)(1),
(2), (4) Date: Mar. 12, 2012

(87) PCT Pub. No.: WO2010/105774

PCT Pub. Date: Sep. 23, 2010

(65) Prior Publication Data

US 2012/0152230 A1 Jun. 21, 2012

(30) Foreign Application Priority Data

Mar. 19, 2009 (EP) ..... 09003941

(51) Int. Cl.
*F24C 3/10* (2006.01)
*F23D 23/00* (2006.01)
*F23D 14/06* (2006.01)

(52) U.S. Cl.
CPC ..... *F23D 14/065* (2013.01); *F23D 23/00* (2013.01); *F23D 2207/00* (2013.01); *F23D 2208/00* (2013.01); *F23D 2208/10* (2013.01); *F23D 2900/14062* (2013.01); *F23D 2900/14063* (2013.01); *F23N 2025/16* (2013.01); *F23N 2037/10* (2013.01)

(58) Field of Classification Search
CPC ..... F24C 3/085
USPC ..... 126/39 E; 431/80
See application file for complete search history.

(56) References Cited

U.S. PATENT DOCUMENTS

| | | | | | |
|---|---|---|---|---|---|
| 3,051,813 | A | * | 8/1962 | Busch et al. | 219/489 |
| 3,825,398 | A | * | 7/1974 | Katchka et al. | 431/80 |
| 4,646,963 | A | * | 3/1987 | Delotto et al. | 236/20 A |
| 4,655,705 | A | * | 4/1987 | Shute et al. | 431/78 |
| 5,186,158 | A | * | 2/1993 | Ferlin | 126/39 H |
| 5,765,542 | A | * | 6/1998 | Fey et al. | 126/39 E |
| 5,842,849 | A | * | 12/1998 | Huang | 431/284 |
| 5,947,370 | A | | 9/1999 | Rona | |
| 6,030,207 | A | * | 2/2000 | Saleri | 431/354 |
| 6,132,205 | A | * | 10/2000 | Harneit | 431/354 |
| 6,263,868 | B1 | * | 7/2001 | Koch et al. | 126/39 R |
| 6,322,354 | B1 | * | 11/2001 | Carbone et al. | 431/284 |
| 6,332,460 | B1 | * | 12/2001 | Paesani | 126/39 R |

(Continued)

FOREIGN PATENT DOCUMENTS

| | | |
|---|---|---|
| DE | 3346929 | 7/1985 |
| DE | 19905198 | 8/2000 |

(Continued)

OTHER PUBLICATIONS

International Search Report for PCT/EP2010/001571, dated Jun. 30, 2010, 3 pages.

*Primary Examiner* — Gregory Huson
*Assistant Examiner* — Rabeeul Zuberi
(74) *Attorney, Agent, or Firm* — Pearne & Gordon LLP

(57) ABSTRACT

The invention provides a gas burner (10) with a high power burner unit and a low power burner unit.

17 Claims, 9 Drawing Sheets

(56) References Cited

U.S. PATENT DOCUMENTS

Figure 1:
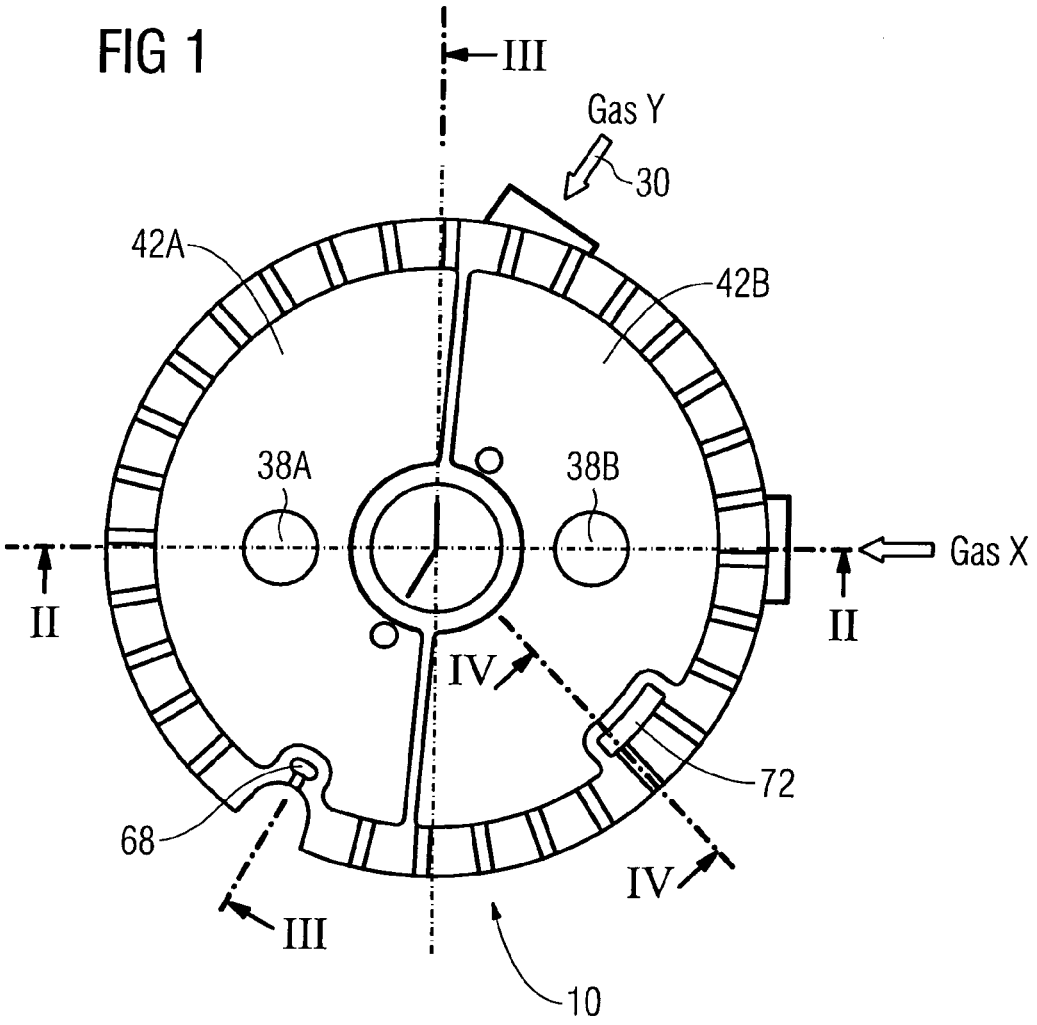

| | | | | |
|---|---|---|---|---|
| 6,607,378 | B2 * | 8/2003 | Harneit et al. | 431/354 |
| 6,736,631 | B2 * | 5/2004 | Ferlin et al. | 431/266 |
| 6,780,008 | B2 * | 8/2004 | Koch et al. | 431/354 |
| 6,780,009 | B2 * | 8/2004 | Harneit | 431/354 |
| 7,291,009 | B2 * | 11/2007 | Kamal et al. | 431/284 |
| 7,841,332 | B2 * | 11/2010 | Pottenger et al. | 126/39 E |
| 7,850,447 | B1 * | 12/2010 | Wylie et al. | 431/266 |
| 7,878,800 | B2 * | 2/2011 | Bettinzoli | 431/354 |
| 2003/0228550 | A1 | 12/2003 | Koch | |
| 2006/0029896 | A1 * | 2/2006 | Poe et al. | 431/285 |
| 2006/0051718 | A1 | 3/2006 | Kamal | |
| 2007/0059654 | A1 * | 3/2007 | Armanni | 431/8 |
| 2009/0047611 | A1 * | 2/2009 | Armanni | 431/284 |

FOREIGN PATENT DOCUMENTS

| | | | | |
|---|---|---|---|---|
| DE | 19907273 | | 8/2000 | |
| DE | 102004017308 | | 10/2005 | |
| WO | 2006077086 | | 7/2006 | |
| WO | WO 2006/117815 | * | 11/2006 | F23D 14/06 |

* cited by examiner

GAS BURNER

TECHNICAL FIELD

The invention relates to a gas burner comprising a burner unit, to a gas appliance comprising one or more of such gas burners, and to a method for operating such a gas burner.

BACKGROUND TECHNOLOGY

Conventional gas cookers comprise a cooking field having several cooking zones, e.g. two, three or four cooking zones. Each cooking zone comprises a gas burner for heating a cooking recipient placed thereon, such as a cooking pot, a pan, etc. The gas burner comprises a gas inlet for supplying gas, a mixing device, e.g. in the form of a venturi pipe, for mixing the supplied gas with ambient air, and a plurality of outlet passages formed in a so-called flame crown for releasing the air/gas-mixture for subsequent combustion. Moreover, gas cookers are typically provided with a spark plug for igniting the air/gas-mixture leaving the flame crown, and with a supporting structure arranged above the burners for receiving cooking recipients thereon.

The gas burner of simple, conventional cooking zones is usually directly operated by means of a knob, which is provided at the operating panel of the gas cooker. The knob is operated to control a valve for adjusting the flow rate of the combustion gas, which is supplied to the gas burner via the gas inlet. Further developed cooking zones comprise an additional temperature sensor for sensing the actual temperature of the cooking recipient. The sensor probe of the sensor may be placed in a common plane with the upper side of the supporting structure, such that the sensor probe is in close contact with a cooking recipient placed thereon. Alternatively, the sensor probe can be held by a spring element in a position slightly above the plane defined by the upper side of the supporting structure. Accordingly—when a cooking recipient is placed on top of the support—the sensor probe is pushed down due to the self weight of the recipient and compresses the spring element. Thus a tight contact between the recipient and the sensor probe can be ensured. A cooking zone comprising such a temperature sensor is not controlled directly by the is above mentioned knob, but by a control device, which controls the flow rate of the combustion gas through the valve based on a comparison of a target temperature defined by the knob and the actual temperature detected by the temperature sensor. A cooking zone of this kind is known from GB 801,207.

The number and size of the outlet passages of the flame crown of a burner are adapted to the maximum gas flow rate for achieving the focussed maximum power of the burner. However, when the gas flow rate is reduced beyond a critical lower limit, the release of the air/gas-mixture cannot be maintained uniformly over all those outlet passages. Accordingly, this critical lower limit defines the minimum power, which can be realized by the burner. Normally, the ratio between the minimum power and the maximum power is 1 to 6. Due to the fact that the maximum and the minimum power of a burner depend from each other, it is hardly possible to provide a burner with a wide power range that enables an operation at very high as well as at very low power.

Starting from this prior art technology it is an object of the present invention to provide a gas burner of the above-mentioned kind, which can be operated within a wide power range. Moreover, it is an object of the present invention to provide a gas appliance comprising at least one of such gas burners and a method for operating such a gas burner.

DISCLOSURE OF THE INVENTION

This object is solved by providing a gas burner of the above-mentioned structure having at least a second burner unit, wherein the first burner unit is a low power burner unit and the second burner unit is a high power burner unit, i.e. the maximum power of the first burner unit is lower than the power of the second burner unit.

Accordingly, the power range is defined by a minimum overall power, which corresponds to the minimum power of the low power burner unit (when the low power burner unit is operated alone at minimum power), and a maximum overall power, which corresponds to the maximum power of the high power burner unit. If the ratio between the minimum power and the maximum power of each burner unit is, e.g., 1 to 6, and if the maximum power of the low power burner unit corresponds to the minimum power of the high power burner unit, the width of the power range for operating the burner can be doubled compared to the one of a known burner having only one burner unit.

Each burner unit advantageously comprises a gas inlet, an injector, a venturi pipe and a plurality of gas outlet passages. Accordingly, each burner unit can be operated independently from the other.

The high power burner unit preferably comprises several injectors and several venturi pipes in order to achieve a uniform gas supply.

The cross sections of the gas outlet passages of the high power burner unit are preferably larger than the ones of the gas outlet passages of the low power burner unit. Accordingly, a low minimum power and thus a low minimum temperature can be achieved by the low power burner unit.

The gas cooking zone preferably comprises a first flame crown for the low power burner unit, a second flame crown for the high power burner unit and an upper cap, which are coaxially arranged one above the other and define the venturi pipes and the gas outlet passages of the two burner units. The flame crowns and the upper cap preferably have an essentially circular disc-shape. The air/gas-mixture leaving the upper flame crown of the high power burner unit can be ignited by the flames of the lower flame crown of the low power burner unit. Therefore, it is only necessary to provide the low power burner unit with a spark plug. Moreover, the entire air/gas-mixture leaving the upper flame crown of the high power burner unit is automatically inflamed by the flames of the low power burner unit. Thus, an inhomogeneous release of the air/gas-mixture from the upper flame crown of the high power burner unit cannot lead to partially extinguished flames. Moreover, the tendency of the flames of the high power burner unit to lift from the upper flame crown is prevented by the presence of the flames of the lower flame crown.

In order to realize an easy assembly and disassembly, the flame crowns and the upper cap are advantageously detachably fixed to each other by means of at least one plug connection.

Preferably, the diameter of the upper cap is larger than the ones of the flame crowns and the upper cap is circumferentially provided at its bottom with a downwardly extending ring-shaped projection or emboss. This emboss stabilizes the combustion of the air/gas-mixture leaving the flame crown of the high power burner unit. It prevents the air/gas-mixture from immediately lifting up from the flame crown of the high power burner unit.

Moreover, the flame crowns and the upper cap preferably define at least one distribution chamber for each burner unit for distributing an air/gas-mixture to the gas outlets.

The gas burner advantageously comprises an ignition spark plug, wherein the first flame crown, the second flame crown and the upper cap define a spark plug supply path for feeding a gas/air-mixture to the spark plug. Moreover, the gas burner preferably comprises a thermocouple, wherein in particular the first flame crown, the second flame crown and the upper cap define a thermocouple supply path for feeding a gas-air-mixture and thus a flame to the thermocouple. In case the combustion is stopped by incident, the continued outflow of the air/gas-mixture poses a threat to people and has to be prevented either by stopping the outflow of the air/gas mixture or by re-lighting the ejected air/gas mixture. The thermocouple allows the detection of the combustion of the air/gas mixture by means of detecting the combustion heat.

Furthermore, the gas burner preferably comprises a temperature sensor for sensing the actual temperature of a recipient to be heated by the gas cooking zone. Accordingly, the burner units can be controlled based on a comparison of a target temperature adjusted by a user and the actual temperature sensed by means of the temperature sensor. For this purpose a control device can be provided that adjusts the power of the two burner units by modifying the gas flow rate in accordance with a target-performance comparison.

The temperature sensor is preferably arranged in a through hole, which extends through the center of the first flame crown, the second flame crown and the upper cap. In order to further increase the accuracy of the measurement of the temperature sensor, the upper cap can comprise an upwardly projecting, ring-like portion surrounding the temperature sensor and acting as a heat screen for protecting the sensor from heat radiated from the burner units.

Accordingly, one of the above-mentioned actions can be taken.

Moreover, the present invention provides a gas appliance comprising at least one gas burner of the above-mentioned type.

Furthermore, the present invention provides a method for operating such a gas burner, whereas the low power burner unit is operated to provide low temperatures and the high power burner unit is operated to provide high temperatures. When the burner is in operation, the low power burner unit has always to be turned on, because it controls the thermocouple. In this regard the ignition spark plug is designed and arranged to ignite the flame of the low power burner unit only. The valve for controlling the low power burner unit can then be operated for adjusting the power between a minimum and a maximum value. The high power burner unit can be optionally switched on or off. As soon as the high power burner unit is switched on, its power can be adjusted between a minimum and a maximum value by manipulating the assigned valve according to the needs of the user.

The air/gas-mixture released from the high power burner unit is preferably ignited by the flame of the low power burner unit. Accordingly, a spark plug has to be provided only for the low power burner unit. Moreover, the flames of the low power burner unit can help to generate a stable combustion of the air/gas-mixture released from the high power burner unit, especially when the high power burner unit is operated at its minimum power. Since the entire air/gas mixture leaving the outlet unit of the upper burner unit is automatically ignited by the flames of the lower power burner unit, an inhomogeneous release of the air/gas-mixture from the outlet unit of the upper burner unit will not lead to partially extinguished flames of the upper burner unit. Moreover, the presence of the flames of the lower flame crown of the low power burner unit suppress the tendency of the flames of the upper flame crown of the high power burner unit to lift from the upper flame crown.

BRIEF DESCRIPTION OF THE ACCOMPANYING DRAWINGS

The detailed configuration, features and advantages of the present invention will become apparent in the course of the following description with reference to the accompanying drawings.

Figure 2:
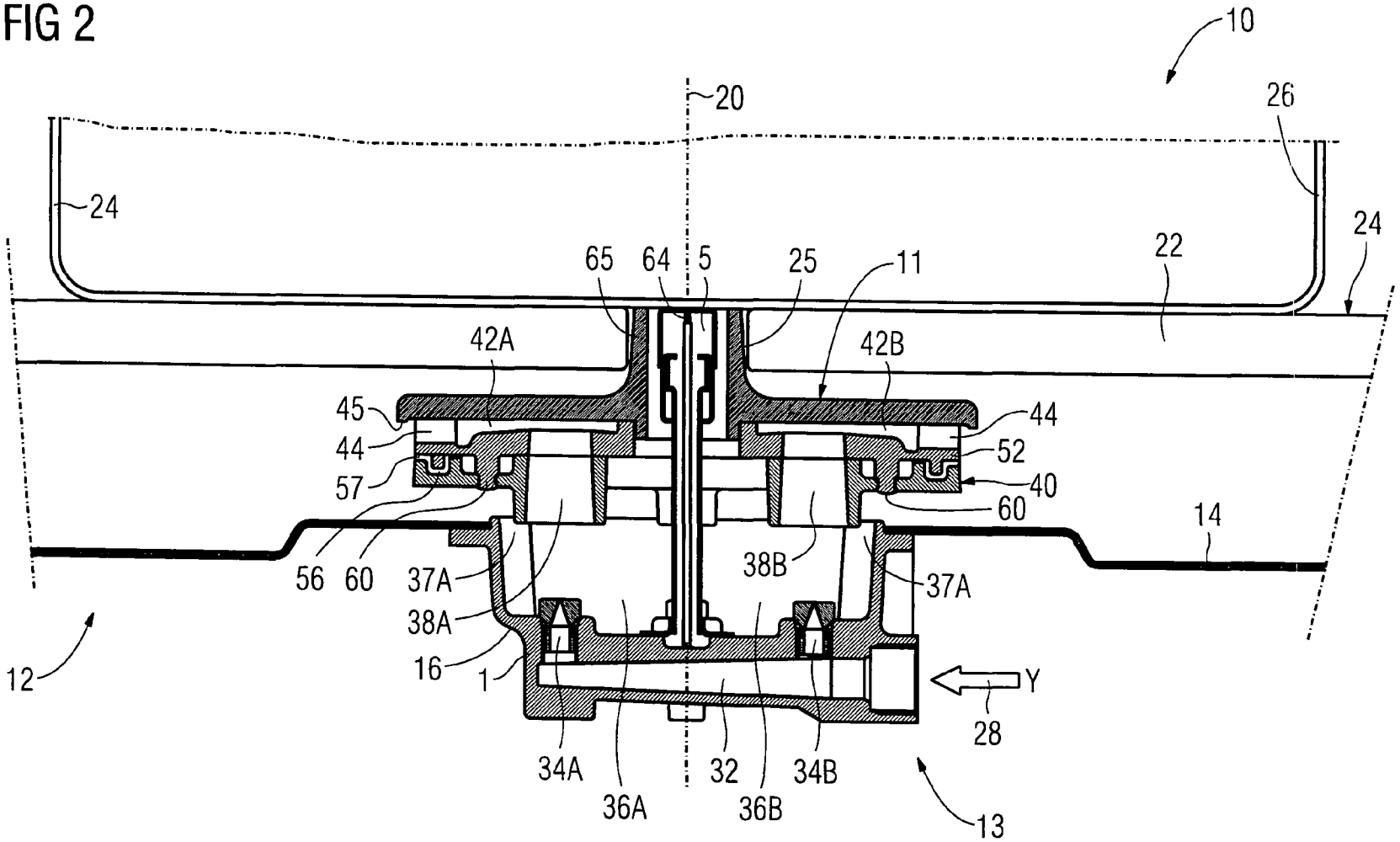
Figure 3:
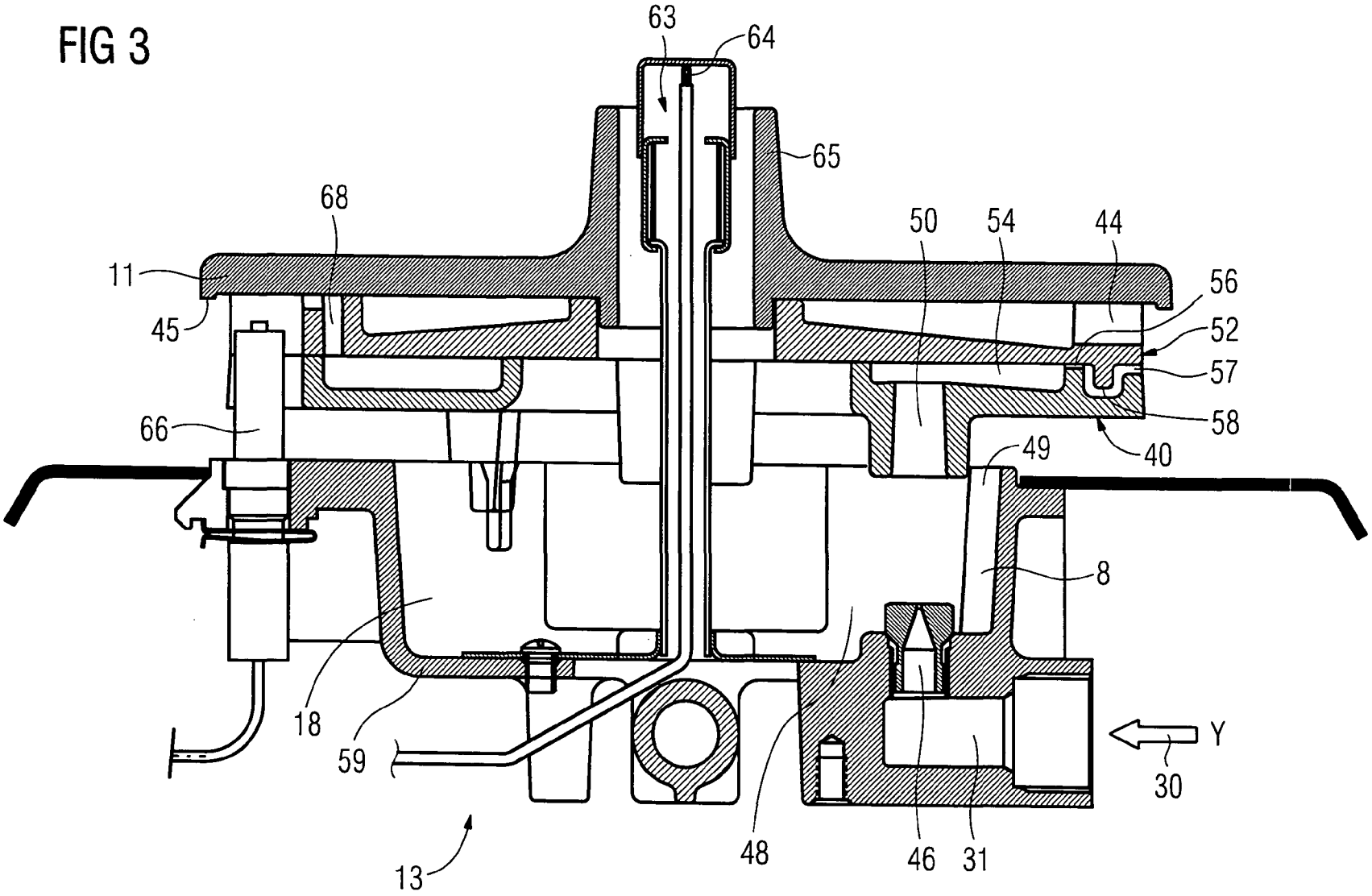
Figure 4:
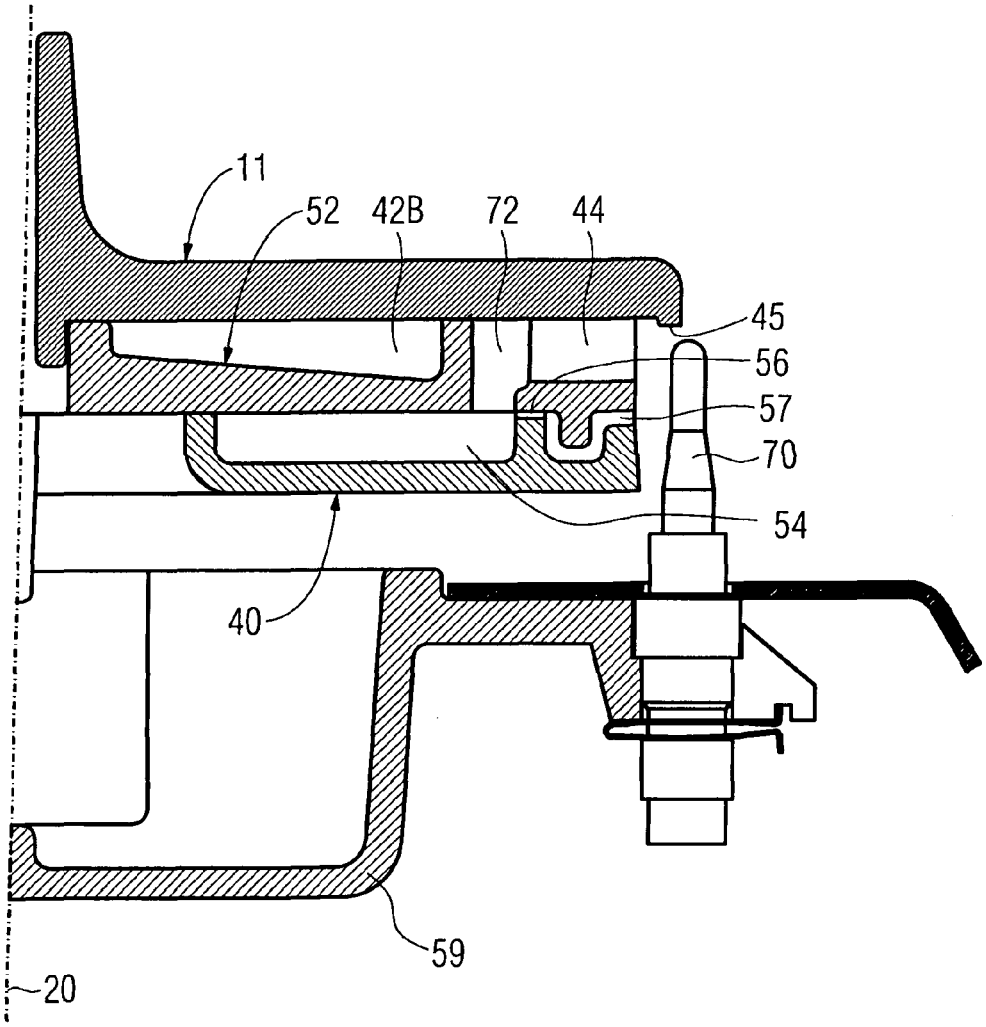
Figure 5:
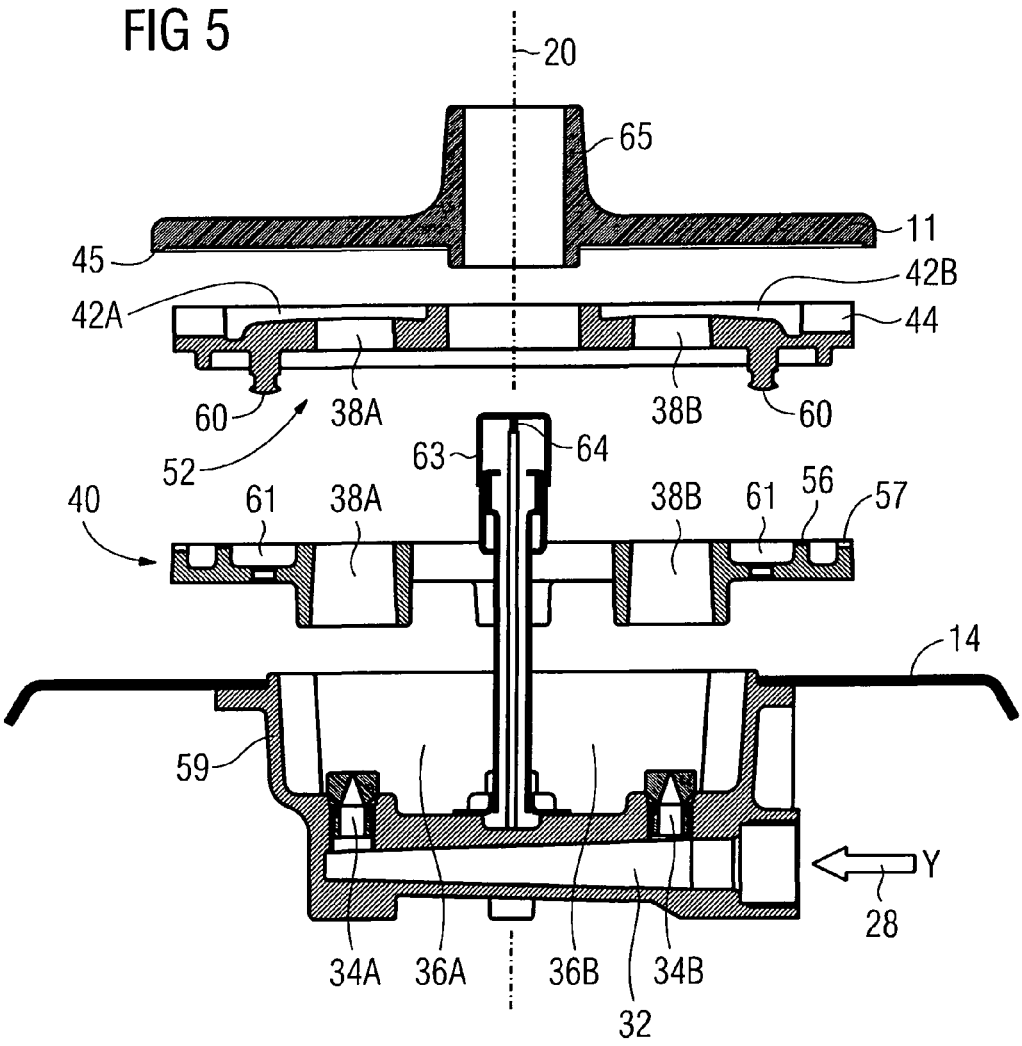
Figure 6:
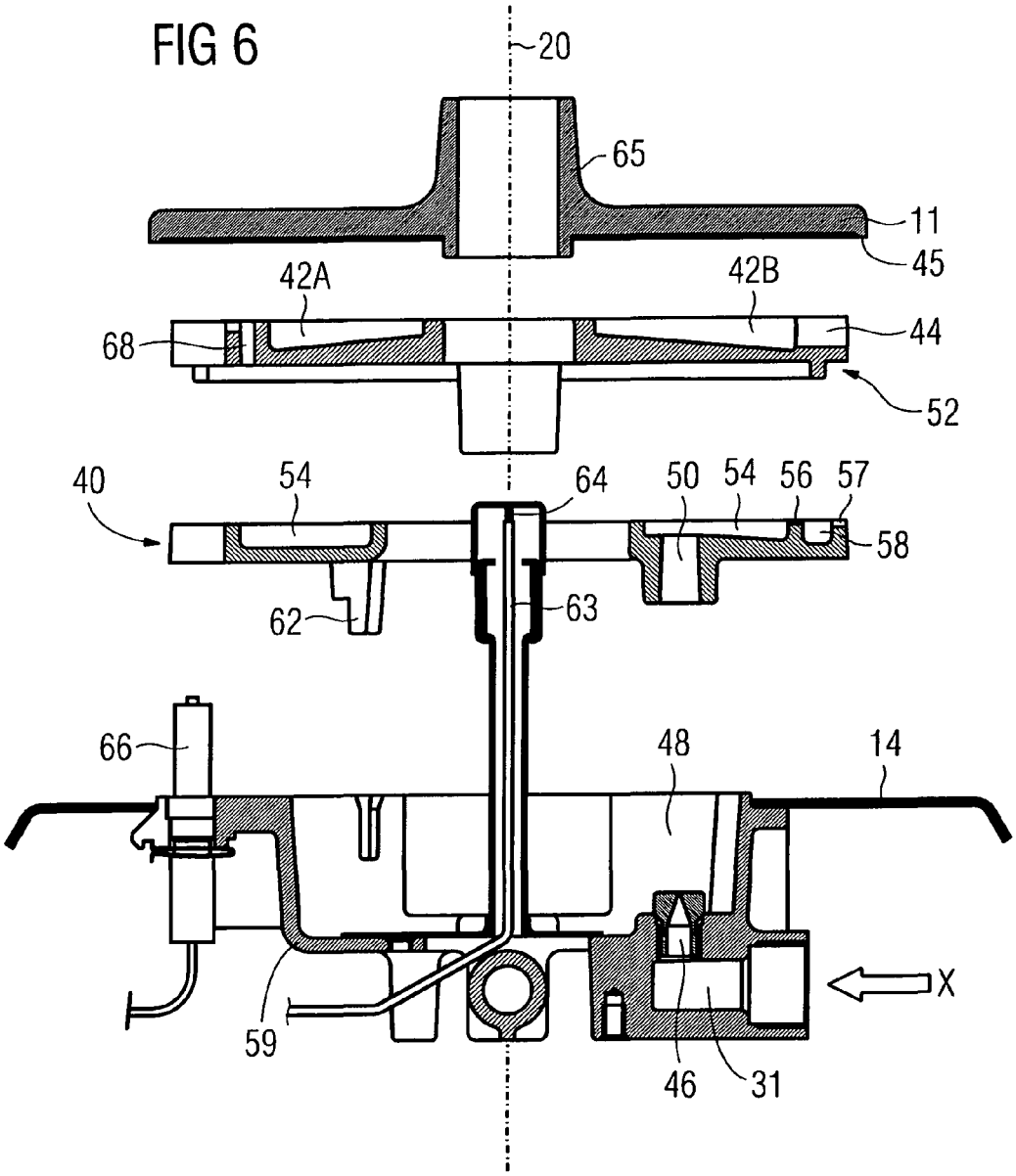
Figure 7:
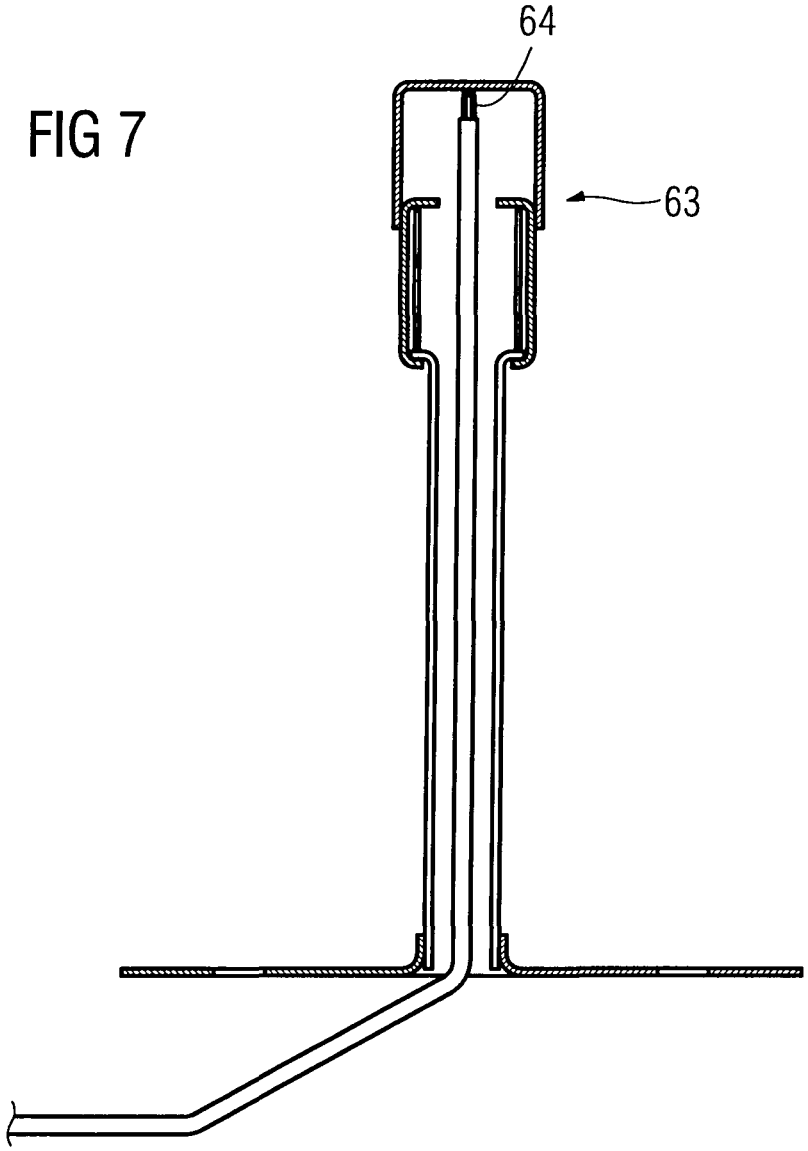
Figure 8:
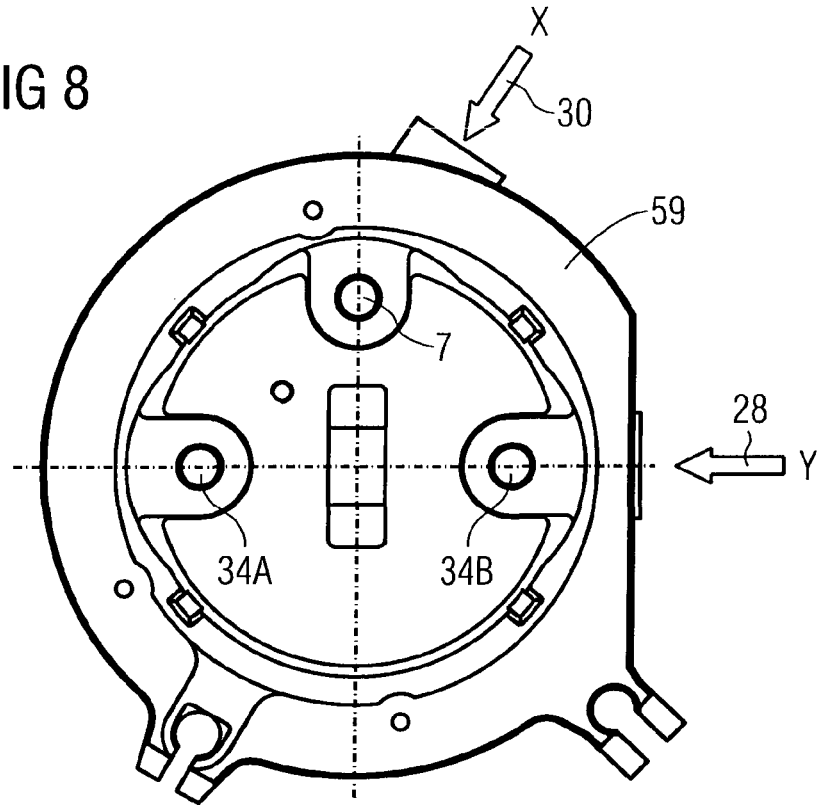
Figure 9:
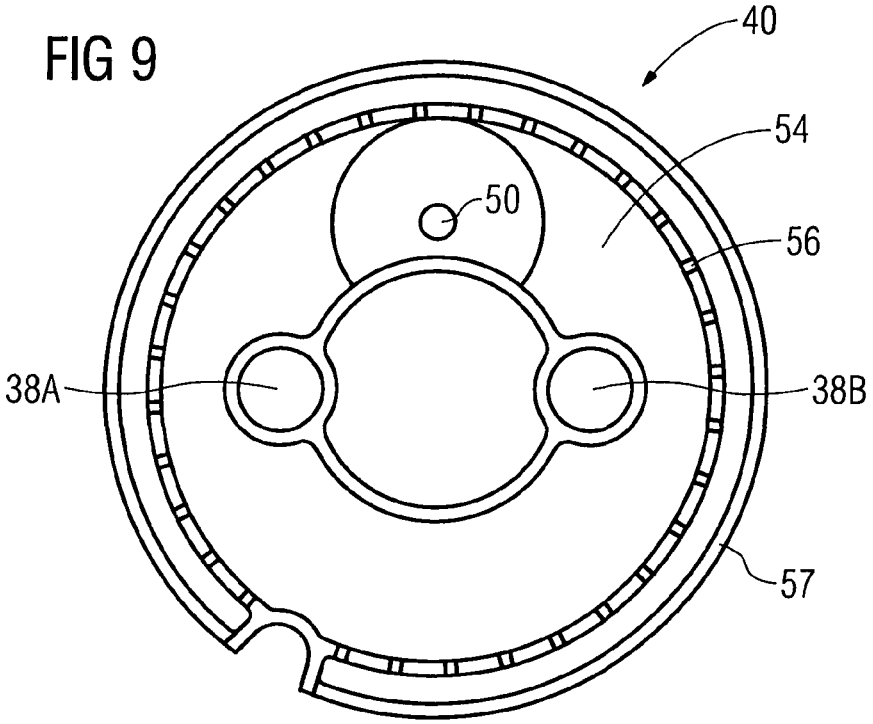
Figure 10:
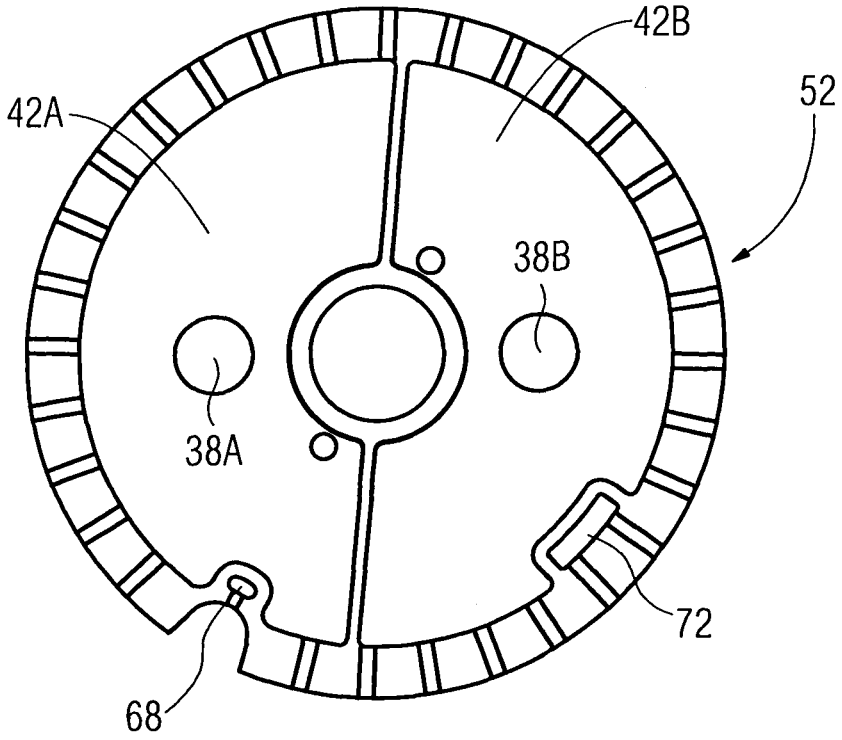

FIG. 1 is a top view of a gas burner with a removed upper cap,

FIG. 2 is a cross sectional view along the line II-II in FIG. 1, showing a high power burner unit in detail, FIG. 3 is a cross sectional view along the III-III in FIG. 1, showing the details of a low power burner unit, FIG. 4 is a cross sectional view along the line IV-IV in FIG. 1, FIG. 5 is an exploded view of FIG. 2, FIG. 6 is an exploded view of FIG. 3, FIG. 7 is a detailed view of a temperature sensor shown in FIGS. 2, 5 and 6, FIG. 8 is a top view of a base body of the gas burner, FIG. 9 is a top view of a flame crown of the low power burner unit, and FIG. 10 is a top view of a flame crown of the high power burner unit.

BEST MODE FOR CARRYING OUT THE INVENTION

Below, one embodiment of the present invention will be described with reference to the figures. In the figures, like parts are denoted by like reference numbers.

The gas burner 10 shown throughout the figures is one of a plurality of gas burners of a gas appliance 12 according to the invention. The gas burner 10 comprises a burner arrangement 13, which is received in a base plate 14 forming the top side of a cabinet of the gas appliance 12. The burner unit arrangement 13 is formed by a high power burner unit 16 and a low power burner 18, which are arranged around a common vertical axis 20. Moreover, the gas appliance 12 comprises a supporting structure 22 defining a flat, horizontally extending upper surface 24 for receiving a cooking recipient 26 thereon, as it is shown in FIG. 2.

The burner units 16 and 18 are supplied with a combustion gas by means of a main pipe (not shown in the figures), which branches to a first branch pipe 28 leading gas to the high power burner unit 16 and a second branch pipe 30 leading gas to the low power burner unit 18. Each branch pipe 28, 30 is provided with a respective valve (not shown) for adjusting the flow rate of the combustion gas flowing therein.

The first branch pipe 28 terminates in a distribution pipe 32, which is connected to two injectors 34A, 34B. The injectors 34A, 34B each lead to a mixing chamber 36A, 36B, in which the combustion gas sucks ambient air through the inlets 37A, 37B. Gas and air then flows through a pair of venturi pipes 38A, 38B, which extend through a lower flame crown 40 of the low power burner unit 18 and a flame crown 52 of the high power burner unit 16. Thereafter, the air/gas-mixture enters distribution chambers 42A, 42B, which are defined between the flame crown 52 of the high power burner unit 16 and the upper cap 11. The two distribution chambers 42A, 42B are each connected to several radially extending gas outlet passages 44 of the flame crown 52. The air/gas-mixture then passes through the gas outlet passages 44 and leaves the flame crown 52 of the high power burner unit 16 for subsequent combustion. The flames of the upper flame crown 52 are kept below the upper cap 11, which radially projects over the upper flame crown 52 and is circumferentially provided at its bottom with an emboss 45 to direct the flames.

The branch pipe 30 terminates in a distribution pipe 31 having an injector 46, which injects the gas with increased speed into a mixing chamber 48 of the low power burner unit 18, which is located above the injector 46. The venturi effect causes the injected gas to suck ambient air through inlet 49. Gas and air then flow through a venturi pipe 50, which is formed in the flame crown 40 of the low power burner unit 18, where they are mixed to create a gas/air-mixture for the subsequent combustion. Thereafter, the air/gas-mixture enters an annular distribution chamber 54, which is best seen in FIG. 9, which supplies the air/gas mixture to a plurality of radial gas outlet passages 56 via ducts 58 having a U-shaped cross section, which causes a velocity drop of the supplied air/gas-mixture. Accordingly, the air/gas-mixture in the ring 57 continuously forms a laminar flame at the low power burner unit 18 through the gas outlet passages 56 in order to create a homogeneous low power flame.

As it can be best seen in the exploded views of FIGS. 5 and 6, the burner arrangement 13 comprises the upper cap 11, the flame crowns 40 and 52 and a base body 59, which is best shown in FIG. 8. Other components are provided integral with these parts.

The bottom of the upper cap 11 forms the ceiling of the distribution chambers 42A, 42B, which are defined by the flame crown 52 of the high power burner unit 16. Moreover, the upper cap 11 rests on these distribution chambers 42A, 42B. The bottom of the flame crown 52 of the high power burner unit 16 forms the ceiling of the distribution chamber 54 defined by the flame crown 52 of the low power burner unit 18. Furthermore, two downwardly protruding pins 60 are formed at the bottom of the flame crown 52, which are inserted in corresponding receptacles 61 formed on the upper side of the flame crown 40. The pins 60 and the receptacles 61 form plug connections for fixing the flame crown 52 to the flame crown 40. The symmetric form of the flame crown 52 of the high power burner unit 16, the pins 60 and the receptacles 61 also assures the correct assembly of the burner arrangement 13. The flame crown 40 of the low power burner 18 is provided at its bottom with spacers 62, which allow the correct arrangement of this flame crown 40 on the base body 59. Accordingly, the injectors 34A, 34B and 46 and the venturi pipes 38A, 38B and 50 are automatically aligned when being assembled.

A temperature sensor 63 extends in the direction of the vertical axis 20 and is arranged in a through hole, which is provided in the centre of the burner arrangement 13 and extends through the flame crowns 40 and 52 and through the upper cap 11. The top of the thermostatic sensor is formed by a sensor probe 64 which projects over the upper surface of the supporting structure 22. The sensor probe 64 is resiliently supported by means of a spring (not shown), so that it is pushed down when a cooking recipient 26 is placed on the upper surface 24 of the supporting structure 22. Thus, a proper contact is ensured between the sensor probe 64 and the cooking recipient 26. The temperature sensor 63 measures the actual temperature of the cooking recipient 26 and transfers the measuring result to an electronic control device (not shown).

A tubular shield element 65 surrounds the sensor probe 64. The shield element 65 is formed integral with the upper cap 11 and serves for shielding the sensor probe 64 from heat radiated by the burner units 16 and 18.

A spark plug 66, which is best shown in FIG. 3, is provided laterally with respect to the flame crowns 40, 52. The spark plug 66 is supplied with the air/gas-mixture through a spark plug supply path 68. The spark plug supply path 68 extends from the distribution chamber 54 of the flame crown 40 of the low power burner unit 18 through the flame crown 52 of the high power burner unit 16 directly to the spark plug 66.

A thermocouple 70, which is best shown in FIG. 4, is provided laterally with respect to the flame crowns 40, 52 and connected to the electronic control device. The thermocouple 70 detects if the combustion of the burners is activated and transmits this result to the control device. The thermocouple 70 is in contact with a flame generated by the air/gas mixture flowing through a thermocouple supply path 72, which extends from the distribution chamber 54 of the flame crown 40 through the flame crown 52 directly to the thermocouple 70.

The two burner units 16 and 18 are independently controlled by the electronic control device. The high power burner unit 16 is operated to obtain high temperatures, whereas the low power burner unit 18 is operated to obtain low temperatures. In the present embodiment the low power burner unit 18 is continuously operated and the high power burner unit 16 is additionally operated to obtain temperatures higher than the ones which can be obtained by operating the low power burner unit 18 alone. The operation of the two burner units 16 and 18 is controlled by means of the electronic control device, as it is described below.

In order to start the operation of the gas burner 10, a user manually sets a desired cooking temperature by means of a user interface or a control knob provided at the control panel of the gas appliance 12 (not shown). The temperature set by the user is transferred to the electronic control device as a target temperature. Accordingly, the control device opens the valves provided in the branch pipes 28 and 30 in correspondence with the target temperature in order to adjust the necessary flow rate. Moreover, the control device lightens the low power burner unit 18 by means of the spark plug 66. As soon as an air/gas mixture is ejected from the flame crown 52 of the high power burner unit 16, i.e. when the valve of the branch pipe 28 of the high power burner unit 16 is opened by the control device, the air/gas-mixture is ignited automatically by the flames of the low power burner unit 18.

The control device continuously monitors the detection results of the thermocouple 70. As soon as the combustion of the ejected air/gas-mixture is not continued, the thermocouple 70 detects the resulting temperature drop. Accordingly, the control device can avoid risks from ejected and not combusted air/gas mixture by either re-lighting the ejected air/gas-mixture or by closing the control valves of the first and second branch pipes 28, 30.

The temperature sensor 63 measures the temperature of the cooking recipient 26, which is placed on the supporting structure 22. During this measuring, the sensor probe 62 is protected by the shield element 65. Accordingly, the measuring result is not influenced by the heat radiated from the burner units 16 and/or 18. The measuring result is transferred to the control device, which compares it with the target temperature set by the user. Based on the result of this comparison, the control device adapts the flow rate of the combustion gas flowing through the first branch pipe 28 by controlling the control valve of the high power burner unit 16.

At the beginning of each cooking operation, the cooking recipient 26 is usually cold so that a high power is required to quickly heat it up. Accordingly, the valve of the high power burner unit 16 should be entirely opened at the beginning of each cooking operation in order to shorten the heating up period.

The invention claimed is:

1. A gas burner comprising:

a first burner unit and a second burner unit, wherein the first burner unit and the second burner unit are configured to suck air from above a base plate forming the top side of a cabinet of a gas appliance, wherein the first burner unit is a low power burner unit and the second burner unit is a high power burner unit, wherein each of the first burner unit and the second burner unit comprises a gas inlet, an injector, a venturi pipe, and several gas outlets, the gas burner further comprising a first flame crown for the first burner unit, a second flame crown for the second burner unit, and an upper cap, wherein the first flame crown, the second flame crown, and the upper cap are coaxially arranged one above the other, wherein the low power burner unit is configured to provide a laminar flame through the gas outlets, wherein the low power burner unit comprises a circumferentially extending duct having a U-shaped cross-section configured to provide a velocity drop of an air/gas mixture, wherein the velocity drop, at least in part, provides the laminar flame, and wherein the U-shaped cross-section is formed by a circumferentially extending protrusion formed on the second flame crown that extends at least partially in a recess formed in the first flame crown.

2. The gas burner according to claim 1, wherein the high power burner unit comprises several injectors and several venturi pipes.

3. The gas burner according to claim 1, wherein the first flame crown, the second flame crown, and the upper cap define the venturi pipes and the gas outlets of the first and second burner units, and wherein the first flame crown, the second flame crown and the upper cap comprise a disc-like shape.

4. The gas burner according to claim 1, wherein the first and second flame crowns and the upper cap are fixed to each other by means of at least one plug connection.

5. The gas burner according to claim 1, further comprising an ignition spark plug, wherein the first flame crown , the second flame crown, and the upper cap define a spark plug supply path for feeding a gas-air- mixture to the ignition spark plug.

6. The gas burner according to claim 1, further comprising a thermocouple, wherein the first flame crown, the second flame crown, and the upper cap define a thermocouple supply path for feeding a gas-air-mixture to the thermocouple.

7. The gas burner according to claim 1, further comprising a temperature sensor for sensing an actual temperature of a recipient to be heated by the gas burner, wherein the temperature sensor is arranged in a through hole extending through the center of the first flame crown, the second flame crown, and the upper cap.

8. A method for operating a gas burner according to claim 1, wherein the low power burner unit is operated to provide low temperatures and the high power burner unit is operated to provide high temperatures.

9. The method according to claim 8, wherein the low power burner unit is continuously operated and the high power burner unit is additionally operated to obtain temperatures higher than the ones obtainable with the low power burner unit.

10. The method according to claim 8, wherein an air/gas-mixture released from the high power burner unit is lighted by a flame of the low power burner unit.

11. The method according to claim 8, wherein the first and second burner units are controlled based on a target temperature, which is set by a user, and an actual temperature, which is sensed by a temperature sensor.

12. The gas burner according to claim 1, wherein the gas outlets of the high power burner unit are larger in size than the gas outlets of the low power burner unit.

13. The gas burner according to claim 1, wherein the first flame crown, the second flame crown, and the upper cap define distribution chambers for each burner unit for distributing an air-gas-mixture to the gas outlets.

14. The gas burner according to claim 7, wherein the upper cap comprises an upwardly projecting, ring-like portion surrounding the temperature sensor and acting as a heat screen.

15. The gas burner according to claim 13, wherein at least one of the distribution chambers is formed between the upper cap and the second flame crown, the upper cap forming a ceiling of the at least one of the distribution chambers.

16. The gas burner according to claim 5, wherein a portion of the spark plug supply path is formed between the first flame crown and the second flame crown, and wherein another portion of the spark plug supply path is formed between the second flame crown and the upper cap.

17. The gas burner according to claim 6, wherein a portion of the thermocouple supply path is formed between the first flame crown and the second flame crown, and wherein another portion of the thermocouple supply path is formed between the second flame crown and the upper cap.

* * * * *